United States Patent [19]

Inoue et al.

[11] 4,157,365

[45] Jun. 5, 1979

[54] ACCELERATION PUMP OF CARBURETOR

[75] Inventors: Tadashi Inoue, Katsuta; Tohru Nakagawa, Mito; Mineo Kashiwaya, Katsuta, all of Japan

[73] Assignee: Hitachi, Ltd., Japan

[21] Appl. No.: 841,736

[22] Filed: Oct. 13, 1977

[30] Foreign Application Priority Data

Oct. 15, 1976 [JP] Japan ..... 51-122838

[51] Int. Cl.[2] ..... F02M 7/08

[52] U.S. Cl. ..... 261/34 B; 417/274

[58] Field of Search ..... 261/34 B, 39 A; 417/274

[56] References Cited

U.S. PATENT DOCUMENTS

| | | | |
|---|---|---|---|
| 1,660,731 | 2/1928 | Taylor | 261/39 A |
| 1,935,351 | 11/1933 | Chandler | 261/34 B |
| 1,995,601 | 3/1935 | Browne | 261/39 A |
| 2,075,884 | 4/1937 | Bucklen | 261/39 A |
| 2,355,346 | 8/1944 | Weber | 261/39 A |
| 2,625,382 | 1/1953 | Boyce | 261/34 B |
| 3,008,697 | 11/1961 | Dermond | 261/34 B |
| 3,807,709 | 4/1974 | Suda et al. | 261/39 A |
| 3,911,061 | 10/1975 | Reed et al. | 261/34 B |

*Primary Examiner*—Tim R. Miles

*Attorney, Agent, or Firm*—Craig and Antonelli

[57] ABSTRACT

An acceleration pump of a carburetor is constituted by a cylinder and a piston slidably received by the cylinder, so that the delivery rate of the acceleration fuel may be changed in accordance with the change of stroke of the piston within the cylinder. The stroke of the piston is limited by a stopper member adapted to be directly actuated by an incompressible temperature detecting element. The stopper member is so arranged as to be moved in the direction perpendicular to the stroking direction of the piston, so as to provide a fine adjustment of the stroke of the piston and, accordingly, an accurate control of the delivery of acceleration fuel in relation with the change of the engine temperature.

4 Claims, 5 Drawing Figures

ACCELERATION PUMP OF CARBURETOR

LIST OF PRIOR ART REFERENCES (37 CFR 1.56 (a))

The following references are cited to show the state of the art:

U.S. Pat. No. 3,313,530 James T. Bickhaus et al May 20, 1965 261-34.

U.S. Pat. No. 3,313,531 Jerry H. Winkley et al May 20, 1965 261-34.

BACKGROUND OF THE INVENTION

The present invention is concerned with an acceleration pump of a carburetor adapted for use in an internal combustion engine and, more particularly, with an acceleration pump capable of accurately controlling the rate of supply of acceleration fuel in response to the change in the temperature of the engine.

In order to reduce the amount of combustible unburnt substance in the exhaust gas, as well as to decrease the fuel consumption, it has been proposed to reduce the rate of supply of acceleration fuel specifically when the engine temperature is high. To this end, temperature detection is performed making use of suitable temperature detecting means such as a bimetal, temperature-sensitive element including wax and like means.

However, the use of bimetal has been found inappropriate, because the acceleration pump requires, as is well known, a considerably large actuating force. More specifically, the bimetal itself is deflected when the pressure of the acceleration fuel provided by the acceleration pump is applied thereto, so that it cannot perform the correct adjustment of the acceleration fuel supply in accordance with the change in the engine temperature. Generally speaking, a larger amount of acceleration fuel is delivered than the optimum amount for the detected temperature, when the acceleration pump is combined with the bimetal.

For this reason, it is preferable to use an incompressible temperature detecting element for correctly controlling the acceleration fuel in relation with the engine temperature. However, the temperature detecting element has not been used so as to control the stroke of the piston of the acceleration pump, because trouble raises as follows.

In acceleration pump combined with the incompressible temperature detecting element, the arrangement is such that the incompressible temperature detecting element actuates a stopper member which is housed by a cylinder and adapted to be moved in the stroking direction of a piston which is housed also by the cylinder.

Generally speaking, the incompressible temperature detecting element exhibits a larger rate of thermal expansion at higher temperature. Thus, in the above described arrangement, since the stopper member is actuated in the stroking direction of the piston, the displacing amount of the stopper member is increased in direct proportion to the expansion amount of the temperature detecting element.

The stroke of the piston of known acceleration pumps generally falls within the range of between 3 to 5 mm. This stroke is too small to perform an accurate control of the acceleration fuel by the movement of the stopper member. In the worst case, the stopper member is displaced too largely, allowing no stroking of the stopper member.

Therefore, the acceleration pump combined with the incompressible temperature detecting element has not been used practically, in spite of its advantage to maintain a constant delivery rate from the acceleration pump against the fuel pressure.

BRIEF SUMMARY OF THE INVENTION

It is therefore an object of the invention to provide an acceleration pump of a carburetor, which can perform an accurate delivery control of acceleration pump in relation with the engine temperature, making use of an incompressible temperature detecting element.

It is another object of the invention to provide an acceleration pump of a carburetor in which a stopper member is provided for a movement in the direction at right angle to the stroking direction of a piston in the cylinder constituting the acceleration pump, so as to be actuated by an incompressible temperature detecting element for an accurate delivery control of acceleration fuel in relation with the engine temperature.

Thus, according to the invention, there is provided an acceleration pump of a carburetor capable of performing an accurate delivery control of acceleration fuel, making efficient use of the advantage of the incompressible temperature detector, due to a fine stroke adjustment for a large expansion of the temperature detecting element, which is allowed by the movement of the stopper member in the direction at right angle to the stroking direction of the piston.

These and other objects, as well as advantageous features of the invention will become clear from the following description of the preferred embodiments taken in conjunction with the attached drawings.

DETAILED DESCRIPTION OF THE PREFERRED EMBODIMENTS

The preferred embodiments of the invention will be described fully hereinafter, with reference to the accompanying drawings.

Figure 1:
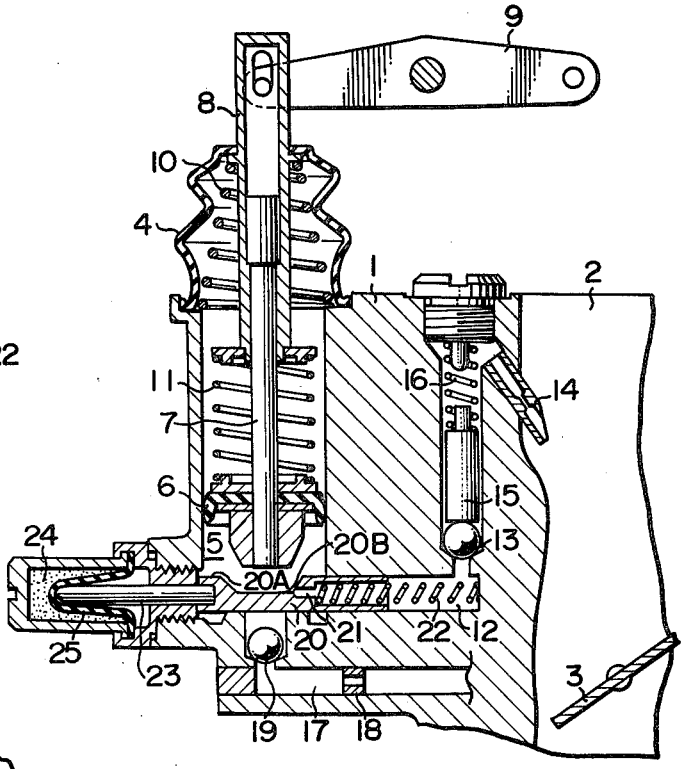
FIG. 1 is a cross-sectional view of an essential part of an acceleration pump embodying the present invention.

Referring at first to FIG. 1, a carburetor 1 has an intake sleeve or barrel 2 in which rotatably disposed is a throttle valve 3 for controlling the amount of intake mixture. An acceleration pump 4 is attached to the carburetor 1, for delivering acceleration fuel when the throttle valve 3 is opened.

A cylinder 5 formed in the carburetor 1 slidably houses a piston 6 to which connected is a piston rod 7. The piston rod 7 is operably connected to a rod guide 8.

The rod guide 8 in turn is operably connected to the throttle valve 3 through a lever 9, so as to transmit the rotational displacement of the throttle valve 3 finally to the piston 6.

A spring 10 is provided for resetting the piston, while a spring 11 provided between the rod guide 8 and the piston 6 acts as a damper.

The cylinder is in communication at its lower end with a fuel passage 12 which in turn is in communication with an injector 14 projecting into the barrel 2, through a check valve 13.

A weight 15 provided on the check valve 13 is loaded by a spring 16 for biasing the check valve 13 in the closing direction. The cylinder 5 further communicates with a float chamber (not shown) through a fuel passage 17, via an orifice 18 and a check ball 19.

The check ball 19 is adapted to disconnect the cylinder 5 from the fuel passage 17 when the piston 6 comes down, and to allow the communication of the cylinder 5 with the fuel passage 17 for introducing the fuel from the float chamber, when the piston 6 is in the raised position.

At the lower portion of the cylinder 5, disposed is a stopper member 20 for movement in the direction at right angle to the stroking direction of the piston 6.

This stopper member 20 is adapted to get into and out of the fuel passage 12, as it moves in the stated direction. Such an arrangement is intended for affording a sufficient space to allow the stopper member to move in the direction at right angle to the direction of stroking of the piston 6.

The stopper member 20 is provided with a small bore 21 for allowing the fuel in the cylinder 5 to get into the fuel passage 12. In addition, the stopper member has an upper stepped portion 20A and a lower stepped portion 20B, and is engaged at its one end by a spring 22 and at its other end by a rod 23. The rod 23 is adapted to be actuated by a wax 24, in accordance with the expansion and shrinkage of the latter, through a diaphragm 25.

The manner of operation of the stated acceleration pump will be described hereinafter.

Figure 2:
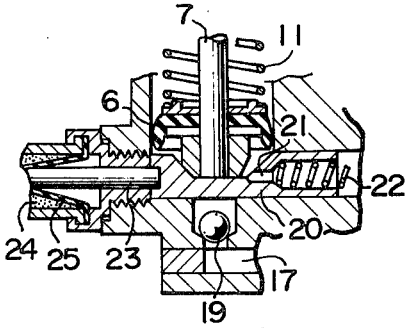
FIG. 2 is a cross-sectional view of the acceleration pump of FIG. 1 in a cold state.

Referring now to FIG. 2 showing the acceleration pump in cold state, the stopper member 20 is biased leftward as viewed on the drawing, by the force of the spring 22, because the wax 24 is not expanded. Consequently, the piston 6 is allowed to stroke until it abuts the lower stepped portion of the stopper member 20.

As the throttle valve 3 is opened, the rotational displacement of the latter is transmitted to the rod guide 8 through the lever 9, so as to lower the rod guide 8 to make the latter compress the damper spring 11. The compression of the damper spring 11 causes a downward movement of the piston, so as to allow the discharge of the fuel in the cylinder 5 into the barrel 2, through the small bore 21, fuel passage 12, check valve 13 and finally through the injector 14. In this state, the delivery rate of the fuel is adjusted to a level which is optimum for the low temperature of the engine, due to the stroking of the piston 6 limited by the lower stepped portion 20B of the stopper member 20.

Figure 3:
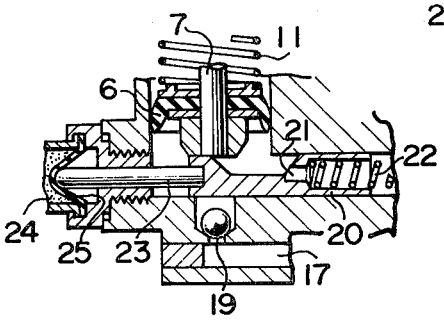
FIG. 3 is a cross-sectional view of the acceleration pump in a hot state.

Referring now to FIG. 3 showing the acceleration pump in hot state, the wax 24 expands in accordance with the heating up of the engine to increase its volume to force the rod 23 into the cylinder 5, so as to drive the stopper member 20 into the fuel passage 12.

As the throttle valve 3 is opened in this state, the rotational displacement of the throttle valve 3 is transmitted, as stated before, to the piston 6 through the lever 9 and the rod guide 8, so that the piston is lowered to discharge the fuel. However, since the wax 24 has been expanded due to the high engine temperature, so as to displace the stopper member 20 at right angle to the stroking direction of the piston 6, i.e. rightward as viewed on the drawing, the piston 6 abuts the upper stepped portion 20A of the stopper member 20 as it comes down, so that the stroke of the piston 6 is limited.

Consequently, the delivery rate of the fuel is reduced by an amount corresponding to the difference of the piston stroke between the cold and hot states, so as to provide the acceleration fuel supply at a rate optimized for the increased engine temperature.

Figure 4:
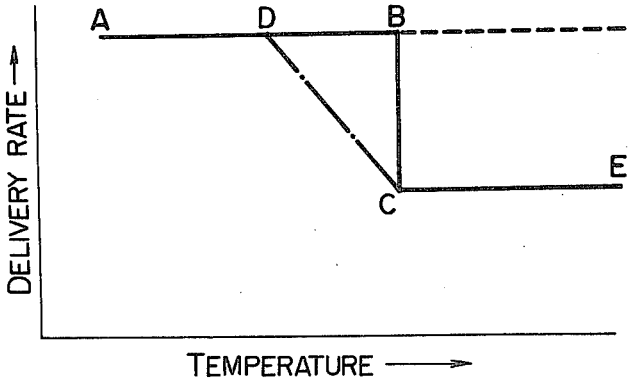
FIG. 4 is a graphical representation of the delivery characteristics in relation with the engine temperature of the acceleration pumps of invention and prior art.

Referring now to FIG. 4 showing the relationship between the engine temperature and the delivery rate of the acceleration pump, the characteristics of the acceleration pump of FIG. 1 and a conventional acceleration pump are represented by full line and broken line curves, respectively.

The conventional acceleration pump performs a constant fuel delivery, irrespective of the engine temperature, which is quite undesirable from the view points of exhaust cleaning and fuel economization. In sharp contrast to the above, in the acceleration pump of the present invention, the delivery rate is maintained at the level of A-D-B, when the engine temperature is still low, due to the stroke of the piston 6 limited by the lower stepped portion 20B of the stopper member 20, but is lowered to the level of C-E, because of the piston stroke limited by the upper stepped portion 20A of the stopper member 20, when the engine temperature has become sufficiently high. Thus, the delivery rate of acceleration fuel is controlled in accordance with the change of the engine temperature.

The embodiment of FIG. 1 has only one step formed on the stopper member 20. However, for obtaining a continuous or linear change of the delivery rate, it is preferred to employ another embodiment as shown in FIG. 5.

Figure 5:
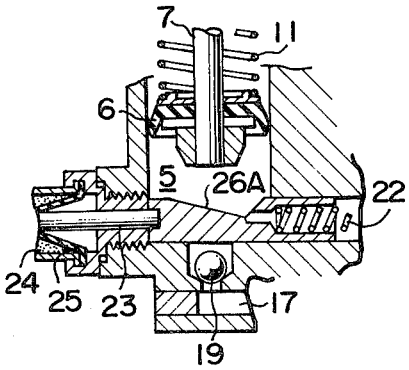
FIG. 5 is a cross-sectional view of an essential part of another acceleration pump in accordance with the invention.

In FIG. 5, same or similar parts to those of FIG. 1 are designated at the same reference numerals.

The embodiment of FIG. 5 has a different construction of the stopper member 26 from that of FIG. 1.

More specifically, the stopper member 26 is tapered as at 26A, so that the portion thereof remote from the wax can allow a larger stroke of the piston.

Therefore, as the wax 24 expands in accordance with the temperature rise of the engine, the stopper member 26 is moved through the rod 23 to make the piston stroke smaller. This functioning of the stopper member provides a linear or smoother change of delivery rate as shown by A-D-C-E in FIG. 4, which is more closely related to the change of the engine temperature.

What is claimed is:

1. An acceleration pump of a carburetor having a cylinder disposed in a fuel passage way connecting a float chamber and a carburetor barrel, and a piston housed by said cylinder and adapted to be actuated at the time of acceleration to discharge the fuel in said cylinder into said carburetor barrel, characterized by a stopper member being positioned below said piston in said cylinder so as to be movable in a direction which is at a right angle to the direction of stroking of said piston, said stopper member being operably connected to an incompressible temperature detecting element for variably limiting the stroke of said piston, and wherein a part of said stopper member is received within said fuel passage way, said part being provided with a throughpassage for communicating fuel in said cylinder with said fuel passage way.

2. An acceleration pump as claimed in claim 1, wherein said stopper member has a tapered portion facing said piston for making the stroke of said piston smaller as the temperature detected by said temperature detector gets higher.

3. An acceleration pump according to claim 1, wherein a spring is provided in said fuel passage way in engagement with said part of said stopper for biasing said stopper toward said detecting element.

4. An acceleration pump according to claim 1, wherein the piston is mechanically connected to a throttle valve by a piston rod that is received within a rod guide, a damper spring being positioned between the rod guide and the piston.

* * * * *